US005927388A

United States Patent [19]

Blangetti et al.

[11] Patent Number: 5,927,388

[45] Date of Patent: Jul. 27, 1999

[54] CONDENSER FOR BINARY/POLYNARY CONDENSATION

[75] Inventors: Francisco Blangetti, Baden, Switzerland; Günter Volks, Lauchringen, Germany

[73] Assignee: Asea Brown Boveri AG, Baden, Switzerland

[21] Appl. No.: 08/966,903

[22] Filed: Nov. 10, 1997

[30] Foreign Application Priority Data

Dec. 20, 1996 [DE] Germany ..... 196 53 256

[51] Int. Cl.[6] ..... F28B 3/00

[52] U.S. Cl. ..... 165/111; 165/110; 165/157; 165/DIG. 205; 165/DIG. 207; 165/DIG. 402; 165/DIG. 424

[58] Field of Search ..... 165/110, 111, 165/157, 158, 205, 207, DIG. 205, DIG. 207, DIG. 402, DIG. 424, DIG. 427, DIG. 429

[56] References Cited

U.S. PATENT DOCUMENTS

| | | | |
|---|---|---|---|
| 1,364,921 | 1/1921 | Ehrhart | 165/DIG. 205 |
| 1,382,676 | 6/1921 | Scanes | 165/DIG. 205 |
| 1,748,676 | 2/1930 | Morgan | 165/DIG. 207 |
| 1,882,474 | 10/1932 | Black | 165/DIG. 424 |
| 1,953,678 | 4/1934 | Govers | 165/111 |
| 2,312,113 | 2/1943 | Mcnulty | 165/DIG. 207 |
| 2,986,377 | 5/1961 | Naab | 165/DIG. 207 |
| 3,298,427 | 1/1967 | Erb | 165/111 |
| 3,387,652 | 6/1968 | Drobka | 165/DIG. 402 |
| 3,503,440 | 3/1970 | Romanos | 165/DIG. 402 |
| 3,507,323 | 4/1970 | Ronnholm et al. | 165/DIG. 402 |
| 3,545,537 | 12/1970 | Hill, Jr. | 165/DIG. 402 |
| 3,572,010 | 3/1971 | Dupps, Jr. | 165/111 |
| 3,837,397 | 9/1974 | Pattigrew | 165/DIG. 424 |
| 5,172,760 | 12/1992 | Hedrick | 165/111 |
| 5,178,210 | 1/1993 | Guillet et al. | 165/111 |
| 5,507,356 | 4/1996 | Roth et al. | 165/111 |
| 5,595,242 | 1/1997 | Jekerle et al. | 165/DIG. 402 |
| 5,642,778 | 7/1997 | Gentry | 165/DIG. 424 |

FOREIGN PATENT DOCUMENTS

| | | | |
|---|---|---|---|
| 89474 | 12/1895 | Germany | 165/111 |
| 744612 | 10/1944 | Germany | 165/111 |
| 2123264 | 12/1971 | Germany | 165/111 |
| 60-14095 | 1/1985 | Japan | 165/111 |

*Primary Examiner*—Ira S. Lazarus
*Assistant Examiner*—Terrell McKinnon
*Attorney, Agent, or Firm*—Burns, Doane, Swecker & Mathis, L.L.P.

[57] ABSTRACT

A dephlegmation condenser for binary/polynary condensation of a vapor mixture is arranged upright. It has tubes (4) through which the coolant flows, an inlet connection (1) arranged in the top region of the coolant tubes and intended for the mixture to be condensed, and a collecting space (2) arranged below the coolant tubes (4) and intended for the condensate to be drawn off. The inlet connection (1) and the collecting space (2) are connected to one another via a condenser shell (3) encasing the tubes (4). The coolant is directed in pure counterflow to the mixture in the predominant part of the condensation space.

The vapor-side, smooth temperature profile achieved is a consequence of the segregation during the condensation. A mixture which is enriched with the higher-boiling component of the mixture condenses at the start of the condensation section, whereas another mixture which is enriched with the lower-boiling component of the mixture condenses out at the end of the condensation section.

8 Claims, 2 Drawing Sheets

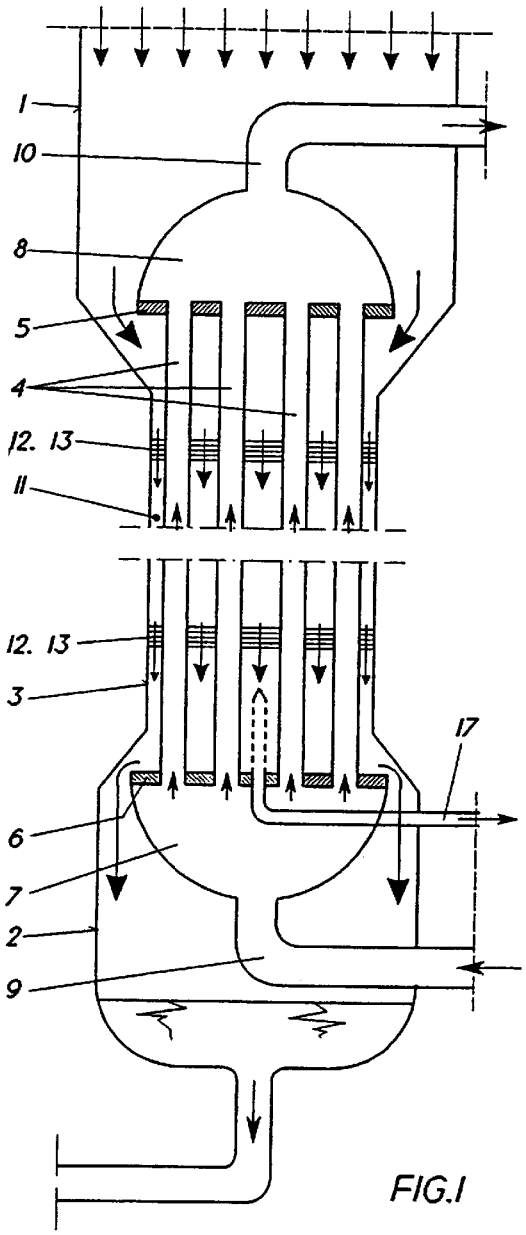
FIG.1
FIG.8
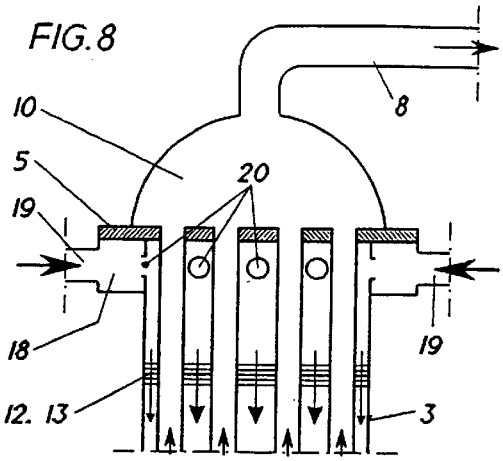
FIG.5
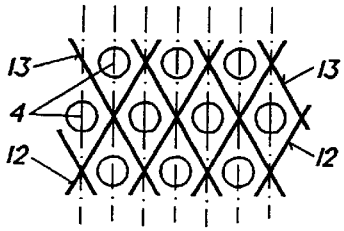
FIG.6
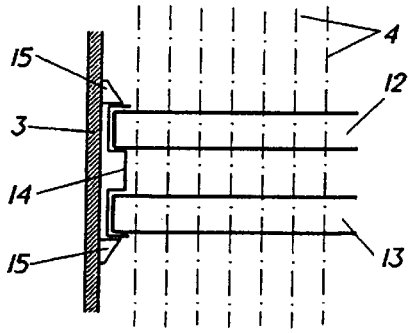
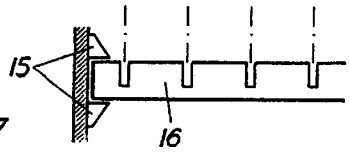
FIG.7

CONDENSER FOR BINARY/POLYNARY CONDENSATION

BACKGROUND OF THE INVENTION

1. Field of the Invention

The invention relates to a condenser for carrying out binary/polynary condensation.

2. Discussion of Background

Such condensers are required, for example, in power generation systems which, in order to increase efficiency, work with a cycle substance which can easily be converted in the energy cycle, for example an ammonia/water mixture. Compared with the conventional Rankine process, more heat can be absorbed at the start of the cycle and less heat can be given off at the end of the cycle by changing the composition of the mixture in the cycle.

SUMMARY OF THE INVENTION

Accordingly, one object of the invention is to provide a novel dephlegmation condenser for binary/polynary condensation, which condenser works with minimum exergy losses.

Here, the term "dephlegmation" relates to the condensation of a vapor mixture with concentration change of the phases participating in the condensation process.

According to the invention, such a condenser is distinguished by an upright arrangement of the tubes through which the coolant flows, an inlet connection arranged at least approximately in the top region of the coolant tubes and intended for the mixture to be condensed, and a collecting space arranged below the coolant tubes and intended for the condensate to be drawn off, the inlet connection and the collecting space being connected to one another via a condenser shell encasing the tubes, and furthermore by the fact that the coolant is directed in pure counterflow to the liquid/vapor mixture in the predominant part of the condensation space, and the mixture and the condensate film flow in parallel, for which purpose the tubes are connected to an inlet-side and an outlet-side water chamber in each case via a tubesheet.

The vapor-side, smooth temperature profile achieved with such an apparatus is a consequence of the segregation or the separation work which occurs due to the binary/polynary condensation. A mixture which is enriched with the higher-boiling component of the mixture condenses at the start of the condensation section, whereas another mixture which is enriched with the lower-boiling component of the mixture condenses out at the end of the condensation section.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying schematic drawings of an apparatus working with an ammonia/water mixture, wherein:

FIG. 1 shows a longitudinal section of a dephlegmation condenser;

FIG. 5 shows an arrangement of the tube support;

FIG. 6 shows a partial section through the condenser with the fastening of the tube support;

FIG. 7 shows a variant of the tube support in longitudinal section;

FIG. 8 shows a vapor-inflow variant of the condenser according to FIG. 1.

DESCRIPTION OF THE PREFERRED EMBODIMENTS

Figure 2:
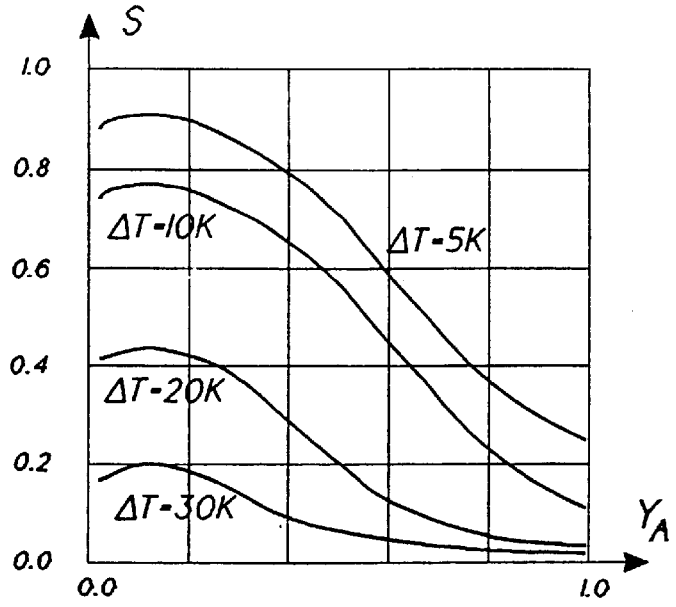
FIG. 2 shows a diagram of separation work S as a function of the concentration of the mixture in the core flow.

Referring now to the drawings, wherein like reference numerals designate identical or corresponding arts throughout the several views, only the elements essential for understanding the invention are shown, and the direction of flow of the working media is designated by arrows, the apparatus shown in FIG. 1 is as a rule associated with other heat- and mass-transfer agents in a column (not shown). Thus it could represent the bottom part of such a column. In its outer form, it essentially comprises cylindrical parts, namely a top inlet connection 1, a bottom collecting space 2 and a condenser shell 3 in between which connects the inlet connection to the collecting space. All elements are in perpendicular arrangement and the mixture to be condensed flows through them from top to bottom.

In the present case, this condensable mixture consists of ammonia ($NH_3$) and water ($H_2O$) . It has an ammonia concentration of 0.6 to 0.3 mass portions. It is fed to the inlet connection 1 at a pressure of about 4.0 to 1.5 bar and at approximately the dew-point temperature, i.e. close to saturation.

The actual heat exchanger consists of a bank of perpendicularly arranged tubes 4, through which the coolant, here water, flows from bottom to top. These tubes, of which there may be several thousand depending on the desired capacity, preferably have a length of about 5 to 20 meters. They are connected in a conventional type of construction to an inlet-side water chamber 7 and an outlet-side water chamber 8 in each case via a tubesheet 6, 5. These water chambers are provided with a feed line 9 and a discharge line 10 respectively. These pass through the walls of the inlet connection 1 on the one hand and of the collecting space 2 on the other hand and are connected in the cooling circuit (not shown).

The correct functioning of the apparatus depends substantially on the fact that a clean counterflow between cooling water and vapor mixture is realized. To this end, the transition from the inlet connection to the tubed condensation part is narrowed in a funnel shape in the plane of the top tubesheet 5. With this measure, the vapor mixture is forced into the tube bank. In addition, passing of the vapor mixture at the boundary is to be largely prevented. The narrowing or the diameter of the condenser shell is therefore dimensioned in such a way that the annular gap 11 between the tubes of the outer bank periphery and the condenser shell is as narrow as possible. It should correspond at most to twice the clearance width between two adjacent tubes.

The vapor-side empty-volume portion of the tube bank, in relation to the sum of all tube circumferences with regard to the trickling film (trickling quantity in kg/m*sec), is dimensioned in such a way that the velocity of the condensate film flowing down on the tubes—which is about 0.8 to 1.2 m/sec in the case of a turbulent film—corresponds approximately to the average flow velocity of the vapor mixture to be condensed. The heat and mass exchange, to be described further below, between the vapor mixture flowing in parallel or co-current and the condensate film is ensured by this measure.

The transition from the tubed condensate part to the collecting space 2 is slightly widened in the plane of the bottom tubesheet 6, so that the condensate collecting on the tubesheet can run off. This widening, like the top narrowing, may likewise be effected in a funnel shape.

A tube 17 passes through the central region of the circular, bottom tubesheet 6, which tube 17 is perforated in its part projecting into the condensation space. This tube 17 is intended for drawing off the non-condensable gases from the condensation space. To this end, it is led out of the apparatus through the bottom water chamber 7 and the wall of the collecting space and is connected to suitable suction means. The remaining condensing portion from the drawn-off mixture, which portion consists virtually only of ammonia, is recovered in a downstream absorption column.

To minimize the exergy losses in the manner described above, such a condenser must fulfill the following conditions:

It must perform maximum separation work, for which reason a dephlegmation condenser is to be used; consequently, it is imperative that it works with a small temperature differences.

The condensate film, once formed, is to retain its integrity on its way to the collecting vessel, i.e. no back-mixing of condensate and vapor is to occur along the condensation section. This requirement can best be achieved by a parallel or co-current flow between condensate film and vapor mixture.

Finally, the coolant is to flow in counterflow to vapor and condensate film.

In the diagram in FIG. 2, the separation work is shown as a function of the concentration at various temperature differences. It goes without saying that the disclosure of accurate numerical values has to be dispensed with in this connection, since these depend on far too numerous parameters. The following qualitative statements are sufficient for understanding the invention.

The concentration Y of a gaseous, condensable mixture is plotted on the abscissa. The separation work or segregation S is indicated on the ordinate. The four curves stand for four different driving potentials of the heat and mass transfer, i.e. the temperature differences between mixture and coolant. The four temperature differences 30, 20, 10 and 5 Kelvin are shown.

The general course of the curves teaches that the separation work is greatest at low mass portions of the low-boiling liquid in the mixture to be condensed.

Furthermore, the diagram teaches that as small a temperature difference as possible between mixture and coolant is to be applied in order to achieve as much separation work as possible.

Finally, it can be seen that a very large temperature difference leads to virtually no separation work. In this case, so-called total condensation takes place, i.e. the mixture condenses virtually as a pure substance on an isotherm.

It is precisely the latter that is to be avoided by the invention. The aim is a non-isothermal condensation of the mixture with a corresponding reduction of the essential exergy losses. According to the above, with regard to maximum separation work, good condensation must be dispensed with. Accordingly, a very small driving temperature difference of, for example, 5 Kelvin is provided for this purpose, which of course leads to very large exchange surfaces.

Figure 3:
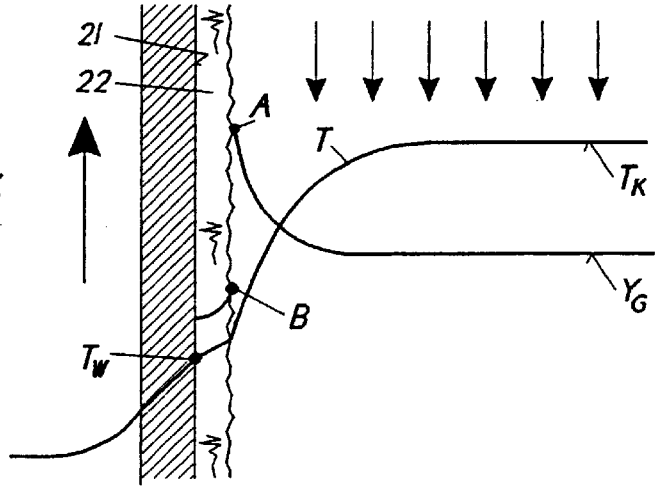
FIG. 3 shows a scheme for the condensation of a saturated flowing vapor mixture with temperature and concentration characteristic.

The mode of operation of the invention is explained below with reference to FIG. 3, which schematically shows the condensation of a saturated, flowing vapor mixture. 21 designates the outer tube wall of a tube through which coolant flows from bottom to top. This tube wall forms a perpendicular, cold surface whose temperature is below the dew-point temperature—compared with that in the concentration in the core of the flow. If the saturated vapor mixture flowing from top to bottom comes into contact with the cold surface, a condensate forms, which flows down on the surface as film 22. In contrast to the condensation of pure substances, phase equilibrium and kinetics bring about the formation of a vapor-side mass-transfer boundary layer and thus a temperature drop at the phase boundary between film and vapor. In effect, enrichment in the lower-boiling component of the mixture occurs in this region. The concentration is therefore higher in this region than in the core flow.

These facts are shown in the figure. $Y_G$ designates the concentration of the lower-boiling component of the mixture, which concentration is constant in the core flow, a factor which is distinguished by its horizontal characteristic. At the phase boundary between film and vapor, however, the concentration increases up to point A. In the condensate film, however, the concentration drops from point B at the phase boundary down toward the tube wall. In this case, points A and B are in so-called phase equilibrium, and the associated temperatures can then be determined from an enthalpy diagram. The temperature characteristic is designated by T in the diagram, $T_K$ being the temperature in the core flow and $T_W$ representing the temperature of the condensate film at the tube wall.

It goes without saying that this consideration only applies locally to the concentration present in each case. With increasing condensation, in which case the higher-boiling component condenses first, the concentration of the mixture in the core flow thus changes continuously. The above considerations are thus to be applied constantly in order to determine the final condensation characteristic.

Figure 4:
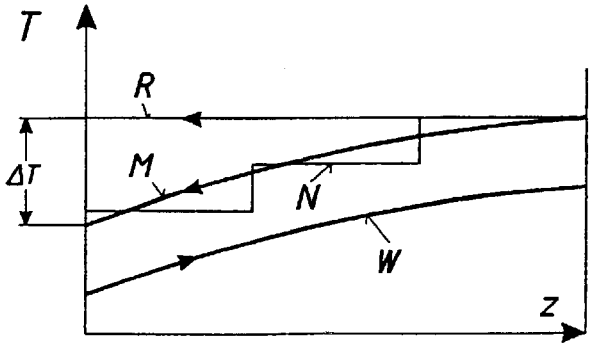
FIG. 4 shows a detail of a diagram with the temperature characteristic along the tubes.

FIG. 4 schematically shows the characteristic M of this non-isothermal, dephlegmation condensation of a mixture in a diagram "Temperature along z" (T, z) where z stands for the height of the perpendicular condensation space. W designates the temperature characteristic of the coolant. R designates the isothermal characteristic of a total condensation. $\Delta T$ represents the gain achievable, which in the present case of an ammonia/water mixture may be several Kelvin, e.g. 5–8 K.

From all that, it can be seen that, despite the large exchange surfaces required, the design cost in the case of the present invention is substantially low compared with conventional methods, in which a comparable, but always poorer, result can be achieved only by multi-pressure condensers being used in the Rankine process. Multi-pressure condensers are only able to realize this gain gradually, as shown in FIG. 4 by the characteristic N, in contrast to the smooth condensation M according to the invention, which condensation M has a continuous characteristic.

A further determining factor for a satisfactory mode of operation of the condenser is that disturbances in the directing of the flow in the condensation space must be largely avoided. Such disturbances could lead to undesirable intermixing of the condensate film and the vapor phase, a factor which has an adverse effect on the dephlegmation condensation. Instead of the supporting plates hitherto conventional in condensers, provision is therefore made to support the tubes by horizontally running bands 12, 13. These bands are arranged alternately in one or more planes over the length of the tubing.

Such a tube support is sketched in FIG. 5. The tube arrangement selected is a so-called triangular arrangement, which is known to accommodate the largest possible number of tubes. Put underneath a first layer of bands 12 is a second layer of bands 13 arranged crosswise. The bands, subjected to flow on their narrow sides, form only an insignificant blockage of the cross section of flow.

The guiding or fastening of such bands on the condenser shell 3 is shown in FIG. 6. In the simplest case, the bands are located in a thermally movable manner in a guide 14 encircling the shell. The annular guide in turn may be fastened in supports 15 at several points of the shell circumference.

A variant of the tube support is shown in FIG. 7. Serrated bands 16 are used here. Two layers each can be nested one inside the other via the serrations and thus result in a rigid lattice through which the tubes 4 are pushed without problem upon assembly in order to then be connected to the tubesheets 5 and 6 in a positive-locking and/or frictional manner.

In order to avoid damaging tube vibrations, such tube supports, depending on tube diameter and wall thickness, are attached at a distance of 1 to 1.2 m over the longitudinal extent of the condensation space.

Finally, a vapor-inflow variant for the condensation space is shown in FIG. 8. Elements having the same function are provided with the same reference numerals as in FIG. 1. In this embodiment, the top tubesheet 5, which is circular as a rule, is widened in its diameter. An encircling annular chamber 18 is welded on at the outer periphery of the top tubesheet 5 and at the outer wall of the condenser shell 3. In the example, the annular chamber 18 is provided with two lateral vapor feed lines 19. The vapor flows radially into the tube bank via suitable openings 20 in the condenser shell 3, which are distributed uniformly over its circumference. Although the topmost part of the tubing is not acted upon in counterflow in this solution, this type of vapor admission does not impair the mode of operation, for the vapor is deflected directly into the perpendicular and a pronounced condenser film has not yet formed in this region. With this solution, the overall length of the apparatus, which is already very "long" on account of the large exchange surfaces required, can be reduced slightly.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by letters patent of the United States is:

1. A condenser for the binary/polynary condensation of a vapor mixture, comprising:

an upright arrangement of coolant tubes through which coolant can flow and on which a condensate film can form and flow, said coolant tube arrangement including a top region, an inlet, and an outlet;

a vapor mixture inlet connection said top region of said coolant tube arrangement for admitting said vapor mixture to be condensed;

a condenser shell encasing said coolant tube arrangement and having a condensation space therein in fluid communication with said vapor mixture inlet connection;

a collecting space arranged below said coolant tube arrangement for condensate to be drawn off, said vapor mixture inlet connection and said collecting space being connected to one another via said condenser shell;

an inlet-side water chamber and an inlet-side tubesheet, said inlet-side water chamber connected to said coolant tube arrangement inlet by said inlet-side tubesheet:

an outlet-side water chamber and an outlet-side tubesheet, said outlet-side water chamber connected to said coolant tube arrangement outlet by said outlet-side tubesheet;

wherein when coolant is directed through said coolant tube arrangement from said coolant tube inlet to said coolant tube outlet in pure counterflow relative to the direction of flow of said vapor mixture in a predominant part of said condensation space, said vapor mixture and said condensate film flow in the same direction.

2. The condenser as claimed in claim 1, wherein said coolant tube arrangement includes tubes which have a sum of all tube circumferences, and includes an empty-volume portion dimensioned in relation to said sum of all tube circumferences so that the velocity of the condensate film flowing down on said tubes corresponds approximately to the average velocity of the vapor mixture to be condensed.

3. The condenser as claimed in claim 1, further comprising horizontally arranged bands mounted in the condenser shell which support said tubes in said condensation space in at least one plane.

4. The condenser as claimed in claim 1, further comprising at least one tube which passes through said inlet-side tubesheet, said tube including a perforated part projecting into said condensation space, said tube extending out of said inlet-side water chamber in order to draw off non-condensable gases from said condensation space.

5. The condenser as claimed in claim 1, wherein said condenser shell further comprises a tubed condensation part and a narrowed, funnel-shaped transition from said inlet connection to said tubed condensation part.

6. The condenser as claimed in claim 1, wherein said inlet connection for said vapor mixture to be condensed further comprises an annular chamber having at least one vapor feed line, and said condenser shell further comprises vapor inlet openings into said condensation space, said annular chamber allowing said vapor mixture to flow through said vapor inlet openings into said condensation space.

7. The condenser as claimed in claim 1, wherein said condenser shell further comprises a tubed condensation part and a widened, funnel-shaped transition from said tubed condensation part to said collecting space.

8. The condenser as claimed in claim 1, further comprising coolant flowing through said coolant tube arrangement from said coolant tube arrangement inlet to said coolant tube arrangement outlet, and vapor mixture flowing through said condenser from said vapor mixture inlet connection through said condensation space.

* * * * *